United States Patent [19]

Shafer et al.

[11] Patent Number: 4,659,446

[45] Date of Patent: Apr. 21, 1987

[54] APPARATUS FOR ELECTROPLATING PRINTING CYLINDERS

[75] Inventors: Donald A. Shafer, Kansas City; Ronald Walker, Lee's Summit; Clarence Yeo, Raytown, all of Mo.

[73] Assignee: Hallmark Cards, Inc., Kansas City, Mo.

[21] Appl. No.: 734,563

[22] Filed: May 15, 1985

[51] Int. Cl.[4] ..... C25D 17/00

[52] U.S. Cl. ..... 204/212; 204/DIG. 7

[58] Field of Search ..... 204/212, 218, DIG. 7

[56] References Cited

U.S. PATENT DOCUMENTS

| | | | |
|---|---|---|---|
| 644,029 | 2/1900 | Cowper-Coles | 204/DIG. 7 |
| 2,473,290 | 6/1949 | Millard | 204/DIG. 7 |
| 3,462,357 | 8/1969 | Karlquist | 204/212 |
| 3,660,265 | 5/1972 | Kangos | 204/212 |
| 3,664,944 | 5/1972 | Buckley | 204/212 |

FOREIGN PATENT DOCUMENTS

| | | | |
|---|---|---|---|
| 0082268 | 10/1982 | European Pat. Off. | 204/218 |
| 2355569 | 5/1975 | Fed. Rep. of Germany | 204/212 |

*Primary Examiner*—T. M. Tufariello

*Attorney, Agent, or Firm*—Neuman, Williams, Anderson & Olson

[57] ABSTRACT

For electroplating of printing cylinders or the like, cup-like shields of non-conductive acid-resistant material are secured at opposite ends of the cylinder for rotation with the cylinder, the shields extending radially outwardly and having a configuration such as to obtain a field distribution by which the metal deposited on the surface of the cylinder is of substantially uniform thickness and density throughout the length of the cylinder.

6 Claims, 4 Drawing Figures

APPARATUS FOR ELECTROPLATING PRINTING CYLINDERS

This invention relates to the electroplating of printing cylinders or the like and more particularly to apparatus, devices and methods by which a metal layer of uniform thickness and high quality is readily and economically obtained without waste of metal and in a manner such as to save time and trouble in subsequent processing steps. The required apparatus and devices are comparatively simple in construction and operation and are otherwise advantageous, especially in obtaining ease of operation while at the same time obtaining a high quality product.

BACKGROUND OF THE INVENTION

In the past, printing cylinders have been prepared by depositing a layer of metal, such as copper, on the surface of a metal cylinder, then filing or grinding or otherwise treating the cylinder to obtain a uniform diameter and to place the cylinder into the proper condition for subsequent etching operations or the like, for printing operations therewith.

The preparation of such cylinders has been time consuming, especially with respect to treating the cylinders after plating, and even with careful work, the results obtained have not always been satisfactory.

SUMMARY OF THE INVENTION

This invention was evolved with the general object of improving the quality of plated cylinders used for printing operations or the like and facilitating the production thereof.

An important aspect of the invention relates to the discovery and recognition of problems involved with the procedures used in the past. The problems have included the production of rough and uneven deposits, the production of brittle and high-stressed deposits and the production of irregular and inhomogeneous grain distribution. These problems have been greater at the ends of the cylinder and in addition, the thickness of metal deposited at the ends has been greater than that at the middle of a cylinder, producing a "dog bone" effect. In study and research into the sources of these problems, it is found that all of these problems are related to the fact that there is a higher current density at each end of a cylinder immersed in a plating bath.

In one mode of practicing the invention, a cylinder to be plated is connected to the negative terminal of a supply of plating current while connecting anode means to the positive terminal of the source and while rotating the cylinder about a generally horizontal axis, the anode means and a lower portion of the cylinder being immersed in the bath. The anode means may typically include metal pellets or chips such as copper pellets or chips carried in an anode basket which is immersed in the plating bath.

In accordance with the invention, a shield is provided in at least one end of the cylinder, preferably both, to extend radially outwardly therefrom and into the bath to reduce plating current concentration at the adjacent end of the cylinder.

Each shield is preferably of a non-conductive acid resistant material and each includes a surface portion which extends from an inner edge adjacent the end of the surface of the cylinder to an outer edge spaced radially outwardly therefrom. Preferably, the shields are of annular form, the surface portions being annular and having an inner edge with a diameter equal to that of the cylinder and an outer concentric circular edge. It is also preferable that the shields be affixed to the cylinder or otherwise supported for rotation therewith.

In accordance with an important specific feature, the outer edge of the surface portion of each shield is offset in an axial direction toward the other end of the cylinder in a manner such as to obtain a greater uniformity in the thickness of the plating deposit. It is found that with the proper axial offset and with the shields being otherwise properly formed, in relation to the conditions of operation and the diameter and thickness of the cylinder, it is possible to obtain a substantially uniform thickness of the deposited material from one end of the cylinder to the other.

A very important advantage is that the diameter of the resultant cylinder is uniform and subsequent treating operations such as the filing or grinding steps heretofore employed, are not necessary.

Another very important advantage is that the deposits are very smooth and, in addition, they are ductile, without the brittleness associated with cylinders produced by the prior method.

The grain structure morphology is almost homogeneous end to end, with little variation, allowing more ease in electronic engraving.

This invention contemplates other objects, features and advantages which will become more fully apparent from the following detailed description taken in conjunction with the accompanying drawings.

DESCRIPTION OF A PREFERRED EMBODIMENT

Figure 1:
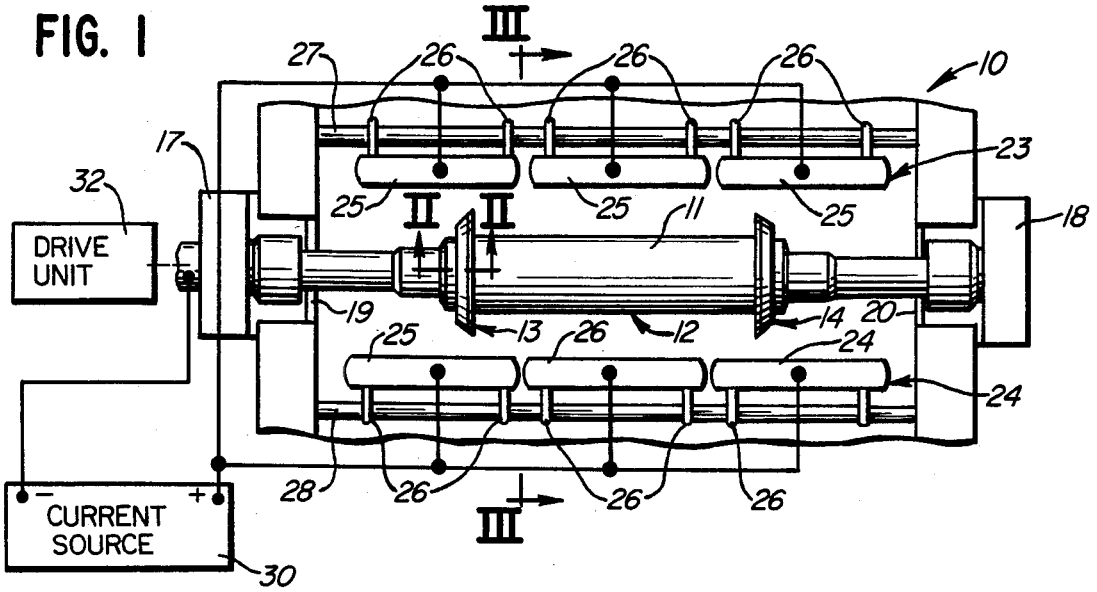
FIG. 1 is a top plan view of electroplating apparatus, shown in use in plating a cylinder, using shield devices constructed in accordance with the invention.

Reference numeral 10 generally designates electroplating apparatus for electrodeposition of a layer on the cylindrical surface 11 of a metal cylinder 12, using a pair of shield devices 13 and 14, constructed in accordance with the principles of the invention. The cylinder 11 is mounted on a shaft structure 16 which is journalled by bearings 17 and 18 for rotation about a horizontal axis. The bearings 17 and 18 are supported adjacent end walls 19 and 20 of a tank 21.

In the illustrated arrangement, the cylinder 11 is disposed between two anode structures 23 and 24, each of which includes three bag units 25 supported by hooks 26 or one of the other of a pair of support bars 27 and 28. Each bag unit 25 may preferably include a metal mesh such as titanium, carrying chips of the metal to be deposited, such as copper, and disposed within a protective plastic cover.

As diagrammatically indicated, the bags of the anode structures 23 and 24 are connected to the positive terminal of a current supply source 30, while the cylinder 11 is connected to the negative terminal of the source 30. For this purpose, suitable slip rings may be provided at one or both ends of the shaft structure 16. The tank 21 is preferably filled with an electrolyte to a level above the lowermost part of the cylinder 11 but below the axis of the cylinder 11. During the plating operation, the shaft structure 12 may be continuously rotated by a suitable drive unit 32, to rotate the cylinder 12 and to promote deposition of a layer of uniform thickness around the cylindrical surface 11 of the cylinder 12.

Figure 3:
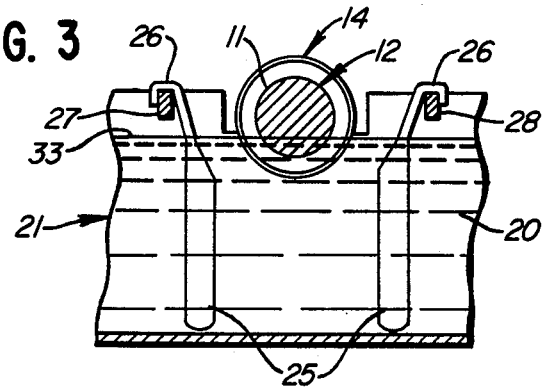
FIG. 3 is a cross-sectional view taken substantially along line III—III of FIG. 1, illustrating one type of positioning of anode bag units relative to the cylinder to be plated.
Figure 4:
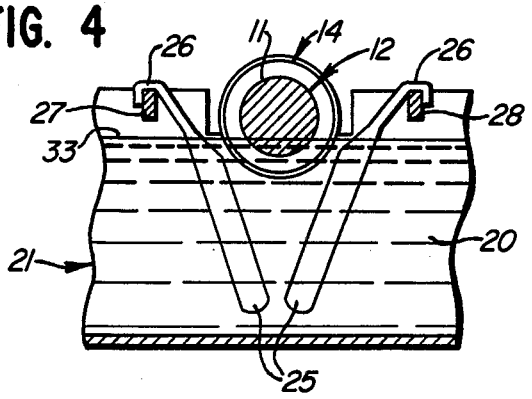
FIG. 4 is a view similar to FIG. 3, illustrating an alternative type of positioning of the anode bag units relative to the cylinder to be plated.

As diagrammatically shown in FIG. 3, the bag units 25 of the two bag structures 23 and 24 may extend generally vertically or, as shown in FIG. 4, they may be angled inwardly in a generally "V" configuration, with the angle between each bag and the horizontal being on the order of 40 to 60 degrees. In FIGS. 3 and 4, the approximate level of the electrolyte is indicated by dotted line 33.

Figure 2:
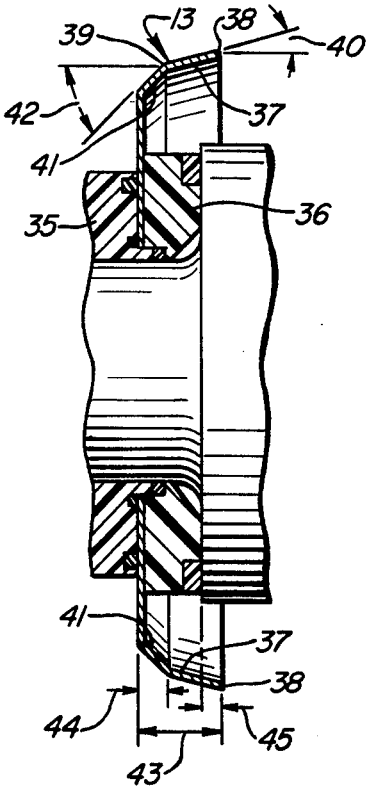
FIG. 2 is a cross-sectional view taken substantially along line II—II of FIG. 1, illustrating one of the shields and the mounting thereof in relation to the cylinder.

The form of the shield is shown in the cross-sectional view of FIG. 2 and it will be understood that the shield 14 at the opposite end has substantially the same construction. The shield 13 as illustrated, has a dish-like configuration and it includes an inner edge portion which is clamped between a pressure plate 35 and a face seal 36 which abuts the end of the cylinder 11. The pressure plate 35 and the face seal 36 may be of a suitable plastic material such as PVC, and both of the shields 13 and 14 may preferably be of an acid-resistant and non-conductive material, such as a suitable rubber or plastic. The shield 13 provides an annular surface in facing relation which faces toward the opposite end of the cylinder, the annular surface including an outer part 37 which extends inwardly from an outer edge 38 to an inner concentric edge 39 and at a certain angle to the axis of the cylinder as indicated by reference numeral 40 in FIG. 2. The annular surface further includes a second part 41 which extends inwardly from the edge 39 and at a greater angle 42 to the axis of the cylinder.

By way of example, the angle 40 may be on the order of 12 degrees and the angle 42 may be on the order of 40 to 60 degrees. Reference numeral 43 indicates the total axial dimension of surface parts 37 and 41 which is typically 1.25 inches. Reference numeral 44 indicates the axial dimension of surface part 41 which is typically 0.375 to 0.5 inches. Reference number 45 indicates an axial offset or overhang dimension between the plane of the outer terminal edge 38 and the plane of the end of the cylinder. Dimension 45 may be from 0 to 0.5 inches and is typically from 0.25 to 0.5 inches.

With further regard to the size and configuration of the shields 13 and 14, it is found that a shield having an outer diameter of 10.75 inches is appropriate for a cylinder having a diameter of from 5 to 7 inches; that a shield having an outer diameter of 11.375 inches is appropriate for a cylinder having a diameter of from 7.1 to 8.9 inches; that a shield having a diameter of 12.75 inches is appropriate for a cylinder having a diameter of from 9 to 10 inches and that a shield having a diameter of 14 inches is appropriate for a cylinder having a diameter of from 10.1 to 11.6 inches. In each case, various lengths of cylinders may be used, varying from 20 to 40 inches, for example. The same voltage may be applied regardless of the length of the cylinder. The voltage may be in the range of from 9.5 to 15 volts and the amperes per square inch of cylinder surface area may vary from zero to 4, 2 to 2.5 amperes per square inch being optimum.

The sizes and configurations of the shields 13 and 14 as set forth in the foregoing examples are appropriate for a plating operation using the bags positioned as shown in FIG. 1, either vertically as shown in FIG. 3, or in a "V" configuration as shown in FIG. 4. The optimum dimensions and configuration depend upon the diameter of the cylinder, the length of the cylinder, the immersion depth of the cylinder into the electrolyte and the spacing distance between and relative placement of the plating cylinder and the anodes. Also, the rate of rotation, the electrolyte agitation rate, the chemical analysis of the electrolyte and the temperature of the process and other variables may have some effect.

In any given case, the optimum size and shape may be determined experimentally and in this regard, it is possible to shine a light in the direction of the cylinder and shade the rays in a manner to allow slight amount of dispersion and interference to occur, and thereby simulate the field distribution obtained through electrolysis, and also thereby suggest a desirable shape of the shield. A selected shape may be milled into wood and the shields may thereafter be of vacuum formed from the wood master, using an acid-resistant plastic.

With shields constructed and used in accordance with the invention, it is possible to obtain very uniform deposit of metal from one end of a cylinder to the other and also to obtain uniform density and quality, minimizing the need for any subsequent processing operation. Generally, a buffing operation is all that may be required for placing a cylinder in condition for a subsequent etching or engraving operation.

It will be understood that modifications and variations may be effected without departing from the spirit and scope of the novel concepts of the invention.

We claim:

1. In apparatus for electroplating the cylindrical surface of a metal cylinder, support and connection means for support of said cylinder and for connection thereof to a negative current supply terminal, anode means for connection to a positive current supply terminal, container means for containing a plating bath and for support of said anode means and said support and connection means to at least partially imerse said anode means and said cylinder in the plating bath for electrodeposition of metal on the surface of said cylinder, and a shield of a non-conductive acid-resistant material affixed to said cylinder at one end thereof and extending radially outwardly therefrom and into the bath to reduce plating current concentrarion at said one end of said cylinder, said shield including a surface portion facing toward the opposite end of said cylinder and extending from an inner edge adjacent said cylinder surface at said one end of said cylinder to an outer edge located in a plane transverse to the axis of said cylinder and spaced outwardly at a uniform radial distance from said cylindrical surface, said surface portion of said shield and said outer edge having a configuration and being so positioned relative to said cylinder as to protect the end of said cylinder form being plated and as to permit deposition of a layer of metal of substantially uniform thickness and grain structure extending on said cylindrical surface from said one end thereof to positions thereof spaced a substantial distance from said end thereof.

2. In apparatus as defined in claim 1, a second shield like the first shield affixed at the opposite end of said cylinder and extending radially outwardly therefrom and into the bath to reduce plating current concentration at said opposite end of said cylinder.

3. In apparatus as defined in claim 1, said plane of said outer edge being offset in an axial direction from a radial plane through said one end of said cylinder and toward the opposite end of said cylinder so as to provide a certain axial offset distance between said one end of said cylinder and said outer edge.

4. In apparatus as defined in claim 1, said support and connection means being arranged to support and rotate said cylinder about a generally horizontal axis with at least a lower portion of said cylinder immersed in said plating bath.

5. In apparatus as defined in claim 1, said annular surface portion of each of said shields including a first part extending inwardly from said outer edge to an inner concentric edge and at a certain angle to the axis of said cylinder and a second part extending inwardly from said inner edge of said first part and at a lesser angle to the axis of said cylinder.

6. In apparatus as defined in claim 5, said inner edge of said first part of said annular surface being approximately in the same radial plane as the adjacent end of said cylinder.

* * * * *

UNITED STATES PATENT AND TRADEMARK OFFICE

CERTIFICATE OF CORRECTION

PATENT NO. : 4,659,446

DATED : April 21, 1987

INVENTOR(S) : Donald A. Shafer, Ronald Walker and Clarence Yeo

It is certified that error appears in the above-identified patent and that said Letters Patent is hereby corrected as shown below:

Column 4, claim 1, line 50, "cylinder" should be -- cylindrical --

Column 4, claim 1, line 57, "form" should be -- from --

Column 4, claim 1, line 62, after "said" insert -- one --

Signed and Sealed this

First Day of September, 1987

*Attest:*

*Attesting Officer*

DONALD J. QUIGG

*Commissioner of Patents and Trademarks*